US006168498B1

(12) United States Patent
Wagner

(10) Patent No.: US 6,168,498 B1
(45) Date of Patent: Jan. 2, 2001

(54) BRASSIERE

(76) Inventor: Penny Jo Wagner, 1000 4th Ave. W/N, Columbia Falls, MT (US) 59912

( * ) Notice: Under 35 U.S.C. 154(b), the term of this patent shall be extended for 0 days.

(21) Appl. No.: 09/095,250

(22) Filed: Jun. 10, 1998

(51) Int. Cl.[7] ..... A41C 3/02
(52) U.S. Cl. ..... 450/58; 450/30; 450/1
(58) Field of Search ..... 450/1, 58, 59, 450/60, 70, 31, 32, 41, 86

(56) References Cited

U.S. PATENT DOCUMENTS

| | | | | |
|---|---|---|---|---|
| 2,493,179 | * | 1/1950 | Wittenberg | 450/60 |
| 3,628,539 | * | 12/1971 | Fredricks | 450/58 |
| 3,908,670 | * | 9/1975 | Dubin | 450/1 |
| 4,816,005 | * | 3/1989 | Braaten | 450/38 |

* cited by examiner

*Primary Examiner*—Gloria M. Hale
(74) *Attorney, Agent, or Firm*—Burkhart & Burkhart; Anne K. Burkhart; Patrick N. Burkhart

(57) ABSTRACT

A brassiere is dislosed including a pair of shoulder straps. A pair of cup members is located generally below the shoulder straps, each of the cups including an inner contact layer covering the breast of a wearer and a unitary outer compression layer slidably disposed in covering relation to the inner contact layer. The outer compression layer is substantially coextensive with the inner contact layer. An adjustment assembly is disposed between each outer compression layer and its corresponding shoulder strap. A securing assembly is adapted and constructed to adjustably secure the outer compression layer to the shoulder strap. Attachment of the outer compression layers to the shoulder straps lifts and compresses the breasts of the wearer to reduce the potential for inertial movement of the breasts. A method of reducing inertial movement a brassiere wearer's breasts is also disclosed. In a brassiere including a pair of cup members and a pair of shoulder straps, a downward force is exerted on the wearer's breasts sufficient to reduce upward inertial movement of the wearer's breasts. An upward force is simultaneously exerted over the entire frontal area of the wearer's breasts sufficient to reduce downward inertial movement of the wearer's breasts.

11 Claims, 4 Drawing Sheets

BRASSIERE

CROSS-REFERENCE TO RELATED APPLICATIONS

None

STATEMENT AS TO RIGHTS TO INVENTIONS MADE UNDER FEDERALLY-SPONSORED RESEARCH AND DEVELOPMENT

None

1. Field of the Invention

The invention relates generally to brassieres. In particular, the invention relates to brassieres having mechanisms to restrict inertial movement of a wearer's breasts.

2. Description of Related Art

Variations in the form and intended functions of brassieres are as old as the garment itself. Some historians assert that as early as 2500 B.C., Minoan women on the Greek isle of Crete employed a bra-like garment that lifted their bare breasts out of their clothing. Years later, ancient Roman and Greek women took the opposite approach, strapping on a garment resembling a breast band to reduce their bust size.

The modern concept of a brassiere can be traced to the latter part of the nineteenth century. U.S. Pat. No. 494,397 to Tucek is directed to a brassiere having a "cup-and-strap" configuration that forms the basis of brassiere construction today. Since that time, countless brassieres have been designed to perform a plethora of functions. The patent literature alone gives testimony to the creative energy has been applied in this area, resulting in garments variously intended to emphasize, minimize, augment, support or protect the breasts of the wearer. Brassieres have even been designed to provide a braless appearance.

More recently, the increased participation of women in strenuous athletic and outdoor activity has given rise to the need for brassieres that reduce the amount of inertial movement, or "bounce", of the breasts during such activities. As women athletes such as equestrians, snowmobilers, and mountain bikers will attest, such inertial movement frequently results in discomfort, soreness, and pain, and may even cause more serious tissue damage in severe cases.

There are many examples of the so-called "sports bras" that have been designed to address these problems. U.S. Pat. No. 4,289,137 to Dell et al. is directed to a brassiere that is made from a combination of Lycra Spandex and POWERKNIT, a material made of 20% Lycra Spandex and 80% nylon. The brassiere is intended to allow downward movement of the breasts while restricting upward movement. U.S. Pat. No. 4,292,975 to Champion et al. shows a brassiere having adjustable shoulder straps and a compression seam running horizontally over the nipple portion of the breast. U.S. Pat. No. 4,325,378 to Wilkinson is directed to a brassiere in which a band member or horizontal flaps are cinched beneath the breasts to compress the breasts inwardly and toward one another. U.S. Pat. No. 5,221,227 to Michels employs a horizontal binding mechanism similar to that in the Wilkinson patent. In addition, the Michels patent provides adjustable shoulder straps to accommodate different bust sizes.

As can be seen from these patents, the problem of breast support during athletic activities has been the object of a high degree of inventive activity. Unfortunately, despite these efforts, none of these known brassieres provides effective restraint against inertial movement of the breast in multiple directions. Each of these known brassieres either expressly or inherently permits relatively unrestricted inertial movement of the breast in one or more directions.

It can be seen from the foregoing that the need exists for a simple, comfortable brassiere that will restrict inertial movement of the breasts in multiple directions.

SUMMARY

The present invention provides an athletic brassiere that allows for freedom of action with adequate support and widely variable, easy adjustment for persons engaged in a variety of strenuous athletic activities. The present invention achieves these and other objects by providing a brassiere including a pair of shoulder straps and a pair of cup members located generally below the shoulder straps. Each of the cup members includes an inner contact layer substantially completely covering the breast of a wearer, and an outer compression layer slidably disposed in covering relation to the inner contact layer. An adjustment and securing assembly is disposed between each outer compression layer and its corresponding shoulder strap, the adjustment and securing assembly being adapted and constructed to adjustably secure the outer compression layer to the shoulder strap. Attachment of the outer compression layers to the shoulder straps lifts and compresses the breasts of the wearer to reduce the potential for inertial movement of the breasts both outwardly and downwardly.

The inner contact layers of the brassiere can be configured to include a cover portion adapted and constructed to cover a lower portion of the wearer's breast, along with a downward compression portion disposed generally above the cover portion. The downward compression portion is adapted and constructed to exert a downwardly-acting force on the respective breasts of the wearer. Thus, in combination with the inward and upward forces exerted by the outer compression layer, the brassiere restricts inertial movement of the breasts in every possible direction.

In an embodiment, the cover portions of the inner contact layers can be fabricated from a resilient material such as LYCRA spandex, and the downward compression portions are fabricated from a material, such as POWERKNIT, having less resilience than the material from which the cover portions are fabricated. The adjustment and securing assembly can include hook and loop fasteners. Hook elements of the hook and loop fasteners can be provided on the outer compression layer, and loop elements of the hook and loop fasteners can be provided on the shoulder straps. This will allow infinite adjustment of the outer compression member to permit the wearer to select the amount of lift and compression based on such variables as breast sensitivity and degree of activity. The outer compression layer can include a body portion overlying the inner contact layer, and a tab portion extending upwardly from the body portion to a point overlying the shoulder strap. In this construction, the hook elements of the hook and loop fasteners can be provided on the tab portion of the outer compression layer. A fastening element, such as a zipper, can be provided between the respective cup members to allow the wearer to more easily put on and take off the brassiere.

A method for reducing inertial movement of a wearer's breasts in a brassiere including a pair of cup members and a pair of shoulder straps is also provided. The method includes the steps of exerting a first force on the wearer's breasts sufficient to reduce upward inertial movement of the wearer's breasts, while simultaneously exerting a second force on the wearer's breasts sufficient to reduce outward and downward inertial movement of the wearer's breasts.

The features of the invention believed to be patentable are set forth with particularity in the appended claims. The invention itself, however, both as to organization and method of operation, together with further objects and advantages thereof, may be best understood by reference to the following description taken in conjunction with the accompanying drawings, in which:

DETAILED DESCRIPTION OF A PREFERRED EMBODIMENT

Figure 1:
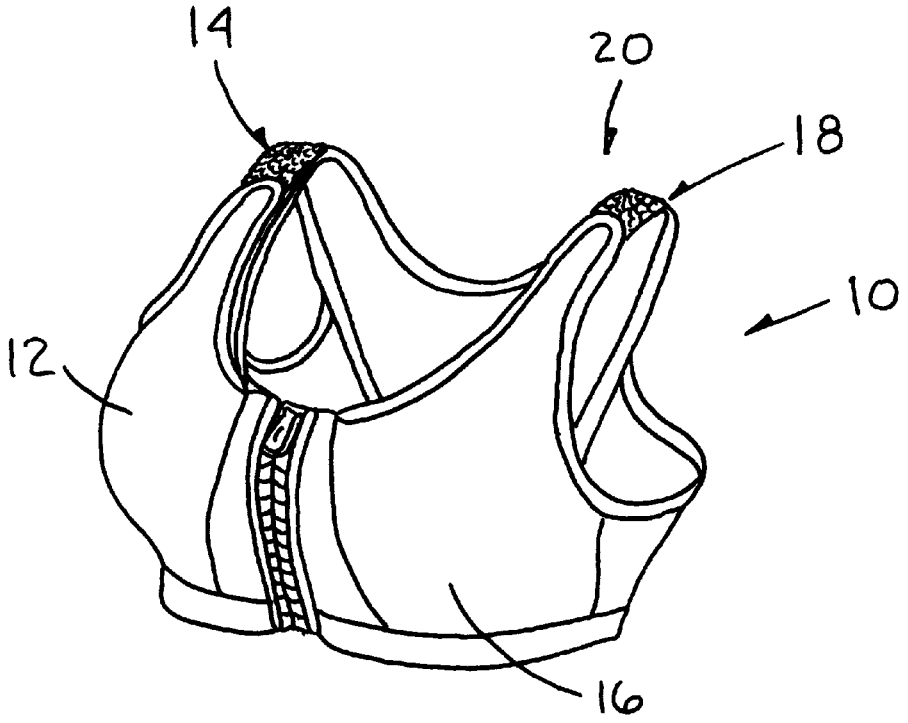
FIG. 1 is a perspective view of a brassiere.

While this invention is susceptible of embodiment in many different forms, there is shown in the drawings, and will herein be described in detail, exemplary embodiments, with the understanding that the present disclosure is to be considered as illustrative of the principles of the invention and not intended to limit the invention to the exemplary embodiments shown and described.

Turning now to FIG. 1, a brassiere 10 includes a right cup member 12 located beneath a corresponding right shoulder strap 14. The brassiere 10 is generally symmetrical; thus, a left cup member 16 is located beneath a corresponding left shoulder strap 18. Each shoulder strap is provided with a width greater than that of a standard brassiere in order to provide increased support and control, as well as to reduce pressure on the shoulders of the wearer. Each shoulder strap is attached to its corresponding cup member via an adjustment and securing assembly 20. The cup members 12, 16 and other components may be made from a cotton/poly LYCRA material, for example, a 55/35/10 cotton/poly LYCRA blend. Such blends are known in the art for their durability, wicking, and elasticity.

Figure 2:
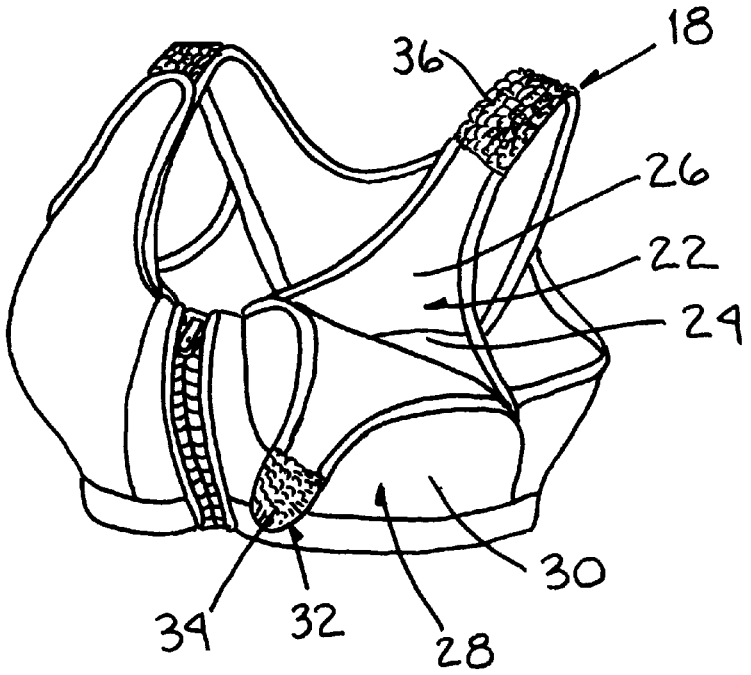
FIG. 2 illustrates the FIG. 1 brassiere in a different position.

As can be seen in FIG. 2, the cup members 12, 16 include an inner contact layer 22 adapted and constructed to be in contact with the breasts of a wearer of the brassiere 10. The inner contact layer 22 includes a body portion 24 and a downward compression portion 26. The cup members 12, 16 also include an outer compression layer 28 which has a body portion 30 overlaying the body portion 24 of the inner contact layer 22. The body portion 30 of the outer compression layer 28 is contiguous with a tab portion 32, which is adapted to extend at least partially over the shoulder straps 14, 18 of the brassiere 10. In the illustrated embodiment, the adjustment and securing assembly 20 is provided as a hook-and-loop fastener system. Hook elements 34 are located on the tab portion 32 of the outer compression layer 28, and loop elements 36 are located on the shoulder straps 14, 18. The inner contact layers are constructed to minimize the number of seams to reduce chafing and rubbing. Further, either the inner contact layer 22 or the outer compression layer 28 may be provided with supplemental support or enhancement mechanisms as needed.

Figure 3:
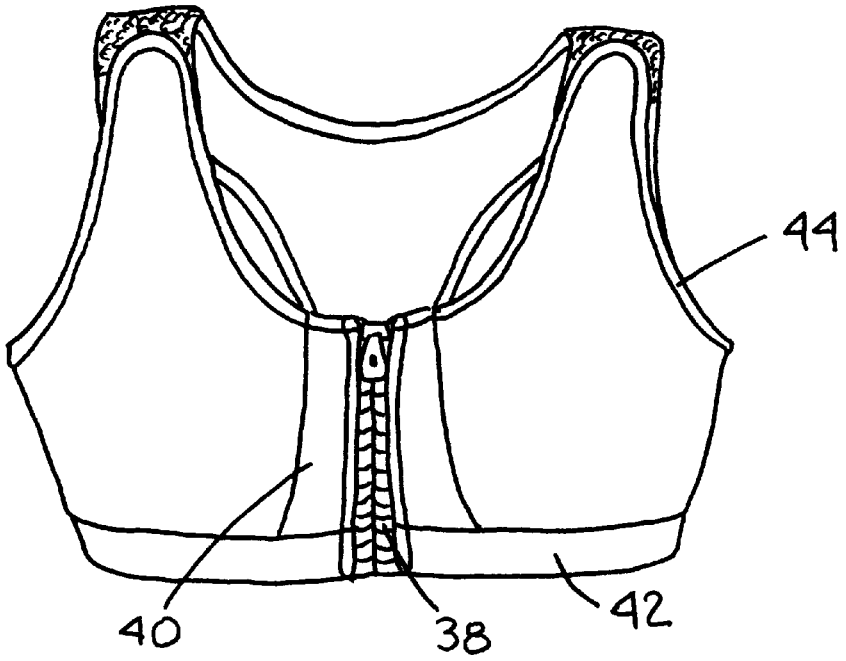
FIG. 3 illustrates a front elevational view of the brassiere in FIG. 1.
Figure 4:
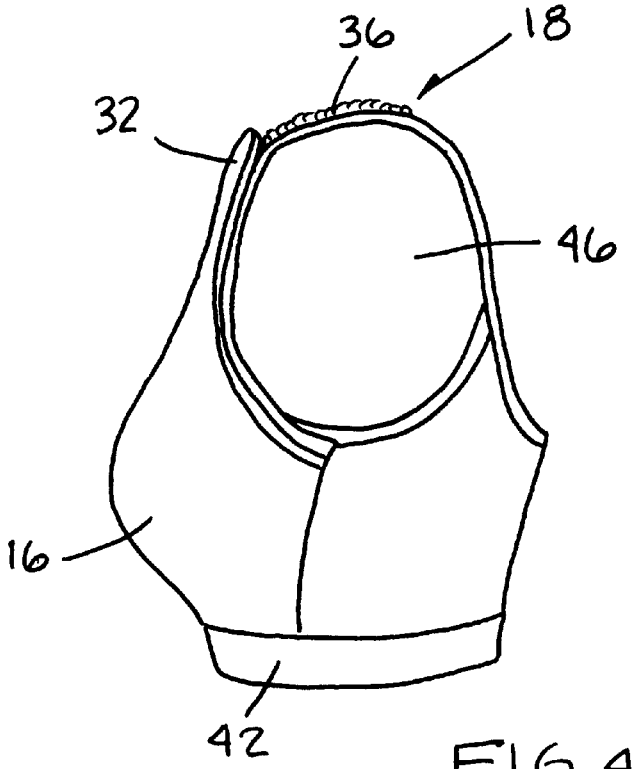
FIG. 4 illustrates a side elevational view of the brassiere in FIG. 1.

FIG. 3 shows a front view of the brassiere 10, in which a fastening device, here provided as a zipper 38, is located between the cup members 12, 16. Front inserts 40 flank the zipper 38 on each side for reinforcing and aesthetic purposes, and an area of backing material (not shown) can be provided behind the zipper 38 to reduce the potential of chafing or irritation from the zipper. A rib band 42 is located at the lower end of the brassiere 10, and encircles the wearer's ribcage below the breastline. Edging or piping 44 is provided at all material edges to prevent raveling of the fabric and to both visually and physically soften the edges of the brassiere 10. The edging or piping 44 may be reinforced with a strip of elastic, sewn in place with a stitch that will stretch, such as a zig-zag stitch. In the side view illustrated in FIG. 4, it can be seen that the various components of the brassiere 10 are connected together such that they form an arm hole 46 on each side of the brassiere 10.

Figure 5:
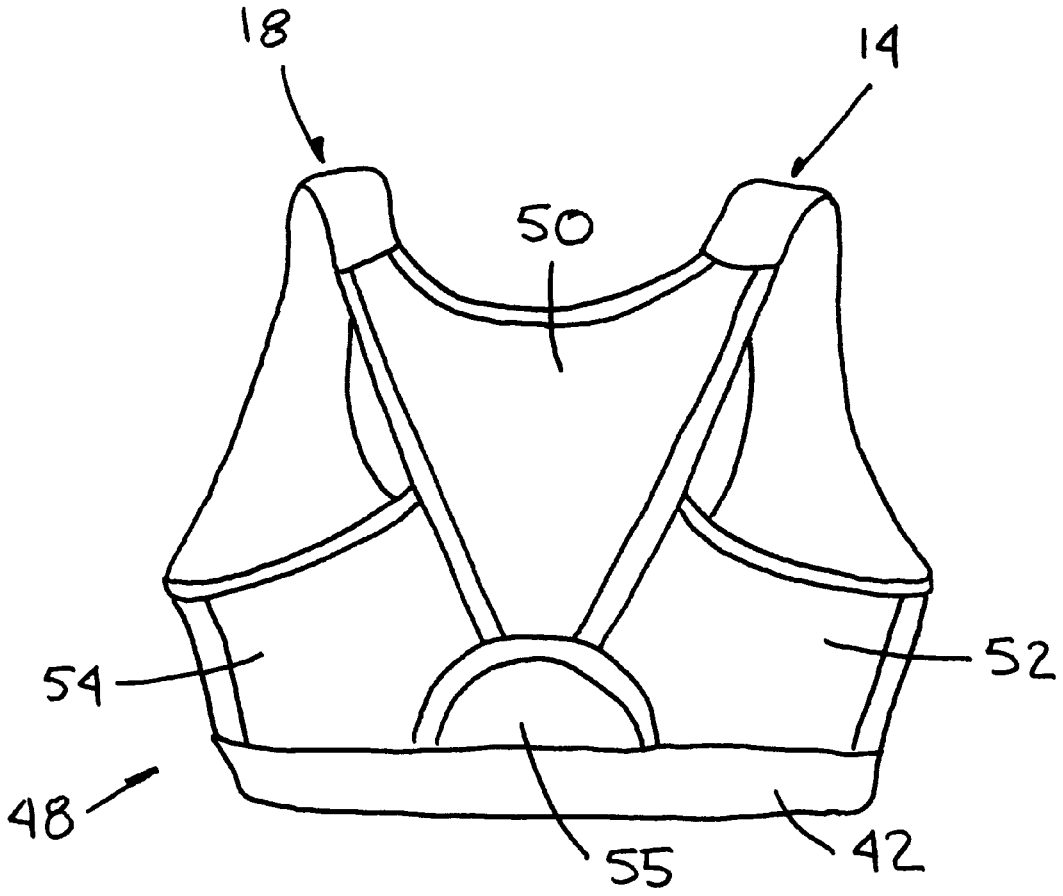
FIG. 5 illustrates a back elevational view of the brassiere in FIG. 1.

The brassiere 10 in this illustrative embodiment is provided with a so-called "racer" back 48, as shown in FIG. 5. Racer backs typically are provided to prevent the straps from coming off of the wearer's shoulders during strenuous physical activity. The racer back 48 includes a yoke portion 50 extending downwardly from the shoulder straps 14, 18. A right side panel 52 and a left side panel 54 connect the yoke portion 50 to the rib band 42 and the left and right cup members 12, 16. An opening 55 can be provided to enhance the ventilation, or "breathability", of the brassiere 10.

Figure 6:
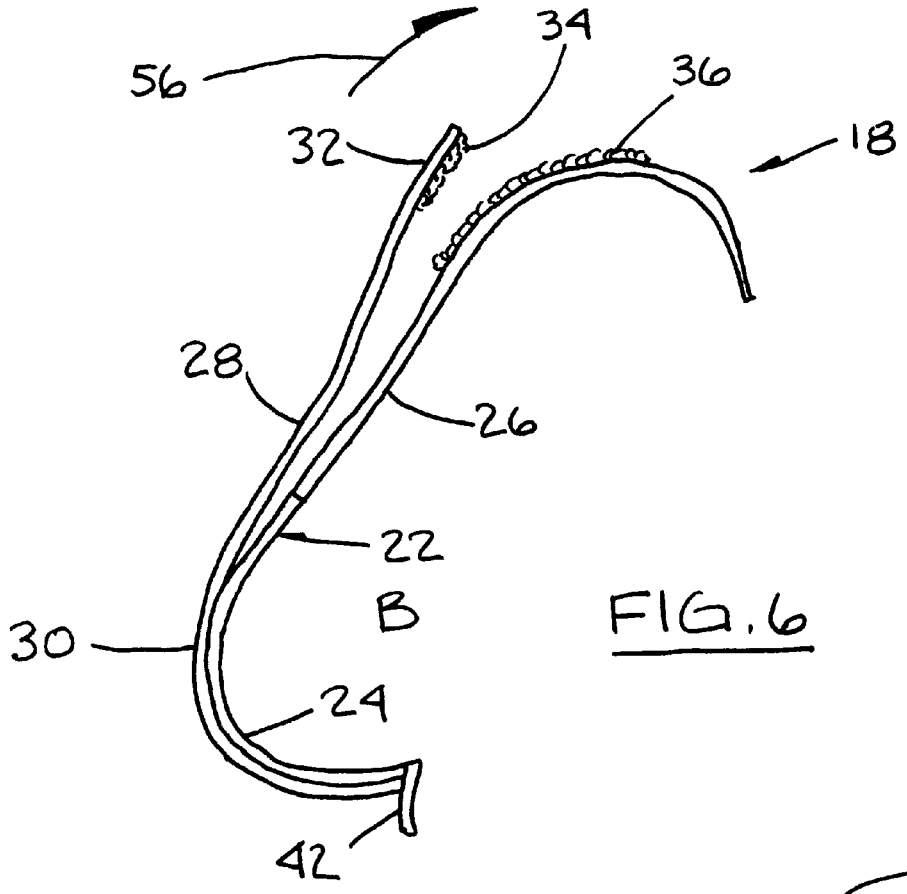
FIG. 6 illustrates a side schematic view of a brassiere.
Figure 7:
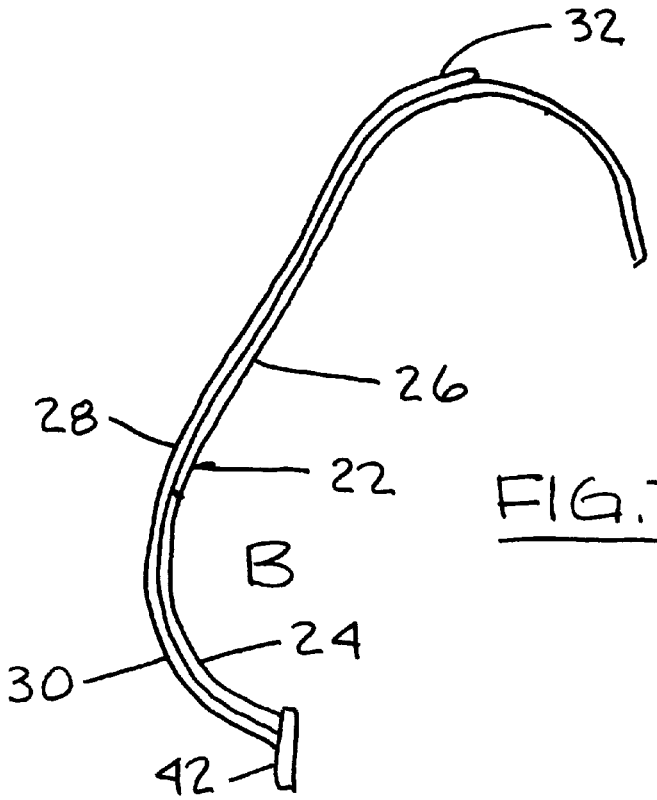
FIG. 7 illustrates a side schematic view of a brassiere.

Operation of the brassiere 10 is schematically illustrated in FIGS. 6 and 7. In FIG. 6, the wearer has donned the brassiere 10, but has not yet secured the outer compression layer 28 to the shoulder strap 18. It can be seen that the downward compression portion 26 is compressing the breast B of the wearer downwardly. Once in this position, the wearer pulls the tab portion 32 in the direction of the arrow 56. This causes the outer compression layer 28 to exert compressive forces upwardly and inwardly against the breast B of the wearer, and compresses the breast B as shown in FIG. 7, after which the tab 32 is secured to the shoulder strap 18. The compressive forces exerted by the outer compression layer 28 lift and compress the breasts of the wearer to reduce the potential for inertial movement of the breasts both outwardly and downwardly. When combined with the downwardly-acting force exerted by the downward compression portion 26, it can be appreciated that the brassiere 10 restricts inertial movement of the breasts in every possible direction.

It will be apparent to those of skill in the art that the particular materials and components set forth above are for illustrative purposes. For example, while it has been set forth that the downward compression portion 26 of the brassiere 10 may be made from POWERKNIT, with the remaining portions fabricated from LYCRA or blends thereof, it is anticipated that any materials providing suitable properties such as wicking, comfort, and elasticity may be used. Similarly, suitable fasteners may be substituted for the zipper 38 and the hook-and-loop fasteners of the adjustment and securing assembly 20. In addition, the value, arrangement, and selection of components constituting the edging or piping 44 provide an exemplary embodiment of the principles discussed herein, and are not intended to be limiting.

Thus it is apparent that in accordance with the present invention, an apparatus that fully satisfies the objectives, aims, and advantages achievable in accordance with the principles of the present invention is set forth in the above exemplary embodiments. While the invention has been described in conjunction with these exemplary embodiments, it is evident that many alternatives, modifications, permutations, and variations will become apparent to those skilled in the art in light of the foregoing description. Accordingly, it is intended that all such alternatives, modifications, permutations, and variations to the exemplary embodiments can be made without departing from the scope and spirit of the present invention.

I claim:

1. A brassiere comprising the following:

a pair of shoulder straps;

a pair of cup members located generally below the shoulder straps, each of the cups including an inner contact layer covering the breast of a wearer and a unitary outer compression layer slidably disposed in covering relation to the inner contact layer, the outer compression layer being substantially coextensive with the inner contact layer; and an adjustment assembly disposed between each outer compression layer and its corresponding shoulder strap, the securing assembly being adapted and constructed to adjustably secure the outer compression layer to the shoulder strap;

whereby attachment of the outer compression layers to the shoulder straps lifts and compresses the breasts of the wearer to reduce the potential for inertial movement of the breasts.

2. A brassiere according to claim 1, wherein each of the inner contact layers comprises the following:

a cover portion adapted and constructed to cover a lower portion of the wearer's breast; and a downward compression portion disposed generally above the cover portion, the downward compression portion being adapted and constructed to exert a downwardly-acting force on the respective breasts of the wearer.

3. A brassiere according to claim 2, wherein the cover portions are fabricated from a resilient material, and the downward compression portions are fabricated from a material having less resilience than the material from which the cover portions are fabricated.

4. A brassiere according to claim 3, wherein the cover portions are fabricated from LYCRA, and the downward compression portions are fabricated from POWERKNIT.

5. A brassiere according to claim 1, wherein the adjustment assembly comprises hook and loop fasteners.

6. A brassiere according to claim 5, wherein hook elements of the hook and loop fasteners are disposed on the outer compression layer, and loop elements of the hook and loop fasteners are disposed on the shoulder straps.

7. A brassiere according to claim 6, wherein the outer compression layer comprises the following:

a body portion overlying the inner contact layer; and a tab portion extending upwardly from the body portion to a point overlying the shoulder strap;

wherein the hook elements of the hook and loop fasteners are disposed on the tab portion of the outer compression layer.

8. A brassiere according to claim 1, further comprising a fastening element between the respective cup members.

9. A brassiere according to claim 8, wherein the fastening element comprises a zipper.

10. In a brassiere including a pair of cup members, each of which includes an inner contact layer, and a pair of shoulder straps, an inertial movement reduction mechanism comprising the following:

downward compression means, forming portions of the respective inner contact layer of the cups, for exerting a downward force on the wearer's breasts sufficient to reduce upward inertial movement of the wearer's breast, the downward compression means being fabricated from a material differing from that of the remainder of the inner contact layers of the cups; and upward and inward compression means, adjustably attached to the shoulder straps, for exerting an upward and inward force on the wearer's breasts sufficient to reduce outward and downward inertial movement of the wearer's breasts.

11. In a brassiere including a pair of cup members and a pair of shoulder straps, a method for reducing inertial movement of a wearer's breasts, the method comprising the following steps:

exerting a downward force on the wearer's breasts sufficient to reduce upward inertial movement of the wearer's breast; and simultaneously exerting an upward and inward force over the entire frontal area of the wearer's breasts sufficient to reduce outward and downward inertial movement of the wearer's breasts.

* * * * *